US006659643B2

(12) United States Patent
Plourde et al.

(10) Patent No.: US 6,659,643 B2
(45) Date of Patent: Dec. 9, 2003

(54) BARRIER ARRANGEMENTS FOR PLASTIC BAGS

(75) Inventors: Eric P. Plourde, Homewood, IL (US); Art Malin, Northbrook, IL (US)

(73) Assignee: Illinois Tool Works Inc., Glenview, IL (US)

( * ) Notice: Subject to any disclaimer, the term of this patent is extended or adjusted under 35 U.S.C. 154(b) by 7 days.

(21) Appl. No.: 10/066,974

(22) Filed: Feb. 4, 2002

(65) Prior Publication Data

US 2003/0147565 A1 Aug. 7, 2003

(51) Int. Cl.[7] ..... B65D 33/16

(52) U.S. Cl. ..... 383/61.2; 383/66; 383/203; 383/208; 383/210

(58) Field of Search ..... 383/66, 61.2, 210, 383/211, 203, 204, 208

(56) References Cited

U.S. PATENT DOCUMENTS

| | | | | | |
|---|---|---|---|---|---|
| 3,226,787 | A | * | 1/1966 | Ausnit | 24/586.1 |
| 3,679,511 | A | * | 7/1972 | Ausnit | 156/251 |
| 3,685,562 | A | * | 8/1972 | Ausnit | 383/37 |
| 3,780,781 | A | * | 12/1973 | Uramoto | 383/204 |
| 4,925,316 | A | * | 5/1990 | Van Erden et al. | 383/210.1 |
| 5,024,537 | A | * | 6/1991 | Tilman | 383/63 |
| 5,077,064 | A | * | 12/1991 | Hustad et al. | 426/106 |
| 5,092,684 | A | * | 3/1992 | Weeks | 383/61.2 |
| 5,121,997 | A | * | 6/1992 | La Pierre et al. | 383/203 |
| 5,358,334 | A | * | 10/1994 | Simonsen | 383/210.1 |
| 5,461,845 | A | | 10/1995 | Yeager | |
| 5,672,009 | A | * | 9/1997 | Malin | 383/204 |
| 5,749,658 | A | * | 5/1998 | Kettner | 383/204 |
| 5,782,733 | A | | 7/1998 | Yeager | |
| 5,806,984 | A | * | 9/1998 | Yeager | 383/204 |
| 5,829,884 | A | * | 11/1998 | Yeager | 383/45 |
| 5,832,570 | A | | 11/1998 | Thorpe et al. | |
| 5,902,047 | A | | 5/1999 | Yeager | |
| 5,930,877 | A | | 8/1999 | Thorpe et al. | |
| 5,954,433 | A | * | 9/1999 | Yeager | 383/203 |
| 6,019,512 | A | | 2/2000 | Yeager | |
| 6,079,878 | A | * | 6/2000 | Yeager | 383/203 |
| 6,088,887 | A | * | 7/2000 | Bois | 24/399 |
| 6,116,314 | A | * | 9/2000 | Johnson | 156/364 |
| 6,177,172 | B1 | | 1/2001 | Yeager | |
| 6,210,038 | B1 | | 4/2001 | Tomic | |
| 6,224,262 | B1 | * | 5/2001 | Hogan et al. | 383/203 |
| 6,244,748 | B1 | * | 6/2001 | Kasai et al. | 383/203 |
| 6,270,257 | B1 | * | 8/2001 | Yeager | 383/203 |
| 6,481,891 | B2 | * | 11/2002 | Yeager | 383/203 |
| 6,499,878 | B1 | * | 12/2002 | Dobreski et al. | 383/5 |
| 2001/0046334 | A1 | * | 11/2001 | Yeager | 383/203 |

FOREIGN PATENT DOCUMENTS

| | | | | |
|---|---|---|---|---|
| EP | 0 513 550 | | 11/1992 | |
| EP | 000528721 A | * | 2/1993 | 383/203 |
| EP | 0 805 018 | | 11/1997 | |
| EP | 1 053 948 | | 11/2000 | |

* cited by examiner

*Primary Examiner*—Jes F. Pascua
(74) *Attorney, Agent, or Firm*—Pitney, Hardin, Kipp & Szuch LLP

(57) ABSTRACT

A reclosable fastener assembly (10) for a reclosable plastic bag (18) in which the fastener assembly (10) is sealed to a single wall (14) of the plastic bag. The fastener assembly (10) includes various tear-openable barrier arrangements with the barrier arrangements sealing and protecting the contents of the reclosable plastic bag (18) before being torn open.

13 Claims, 20 Drawing Sheets

BARRIER ARRANGEMENTS FOR PLASTIC BAGS

FIELD OF THE INVENTION

The invention relates to a reclosable fastener assembly for use with a plastic bag. Specifically, the reclosable fastener assembly with a tear-openable barrier arrangement is sealed to a single film wall of the plastic bag, with the barrier arrangement providing the sealing features of barrier material to the contents of the bag before the barrier arrangement is torn open.

DESCRIPTION OF THE PRIOR ART

The present invention relates to improvements in the bag-making art and may be practiced in the manufacture of reclosable thermoplastic bags and packages of the kind that may be used for various consumer products. Such reclosable thermoplastic bags or packages often include a seal to contain the package moisture and/or to render the package airtight prior to an initial opening of the bag or package. A reclosable fastener assembly protects any remainder of the product therein after the initial opening.

The indicated art is fairly well developed but nevertheless remains open to improvements contributing to the storing qualities of the reclosable bag. In the prior art, Yaeger (U.S. Pat. No. 5,461,845) discloses a reclosable bag and a method of making the bag. The bag has a reclosable fastener assembly connected to a single wall of film used to make the reclosable bag.

It is also known in the art that the sealant, strength and barrier layers of barrier material provide a much higher shield to the transmission of gases and water vapor than other films used in bag manufacturing. An improvement in reclosable bags of the type described above would be to provide various barrier arrangements of barrier material as part of the reclosable fastener assembly, thereby enhancing the barrier properties of the reclosable bag.

SUMMARY OF THE INVENTION

Accordingly, the present invention relates to a fastener assembly and a reclosable bag with the fastener assembly where the fastener assembly is connected to a single film wall of the bag. The fastener assembly generally comprises a strip formed of barrier material having a score line or line of weakness extending along a length of the strip of barrier material with the line of weakness not interfering with the barrier properties of the strip of barrier material. A first interlocking profile is connected to the strip of barrier material and extends parallel to the line of weakness. A mating profile flange is joined to the strip of barrier material on a side of the line of weakness opposite to the first interlocking profile, the mating profile flange including a second interlocking profile mateable with the first interlocking profile. A peel seal feature or closure flange may also be part of the fastener assembly.

In a first use of the fastener assembly with a reclosable bag, a bag is formed from a barrier film material with the bag including front and rear walls, a bottom, top and sides with a line of weakness extending along the bag front wall between the sides. The strip of barrier material of the fastener assembly is joined by a barrier seal to the interior of the bag front wall with the barrier seal encompassing the bag front wall line of weakness and the barrier material line of weakness. In a second use of the fastener assembly, the fastener assembly includes the arrangement of the first use except that the barrier strip includes both interlocking profiles. This is accomplished by the use of an extended barrier strip that bends at an upper section with the two interlocking profiles facing each other on the inner faces of the barrier flange, thereby forming the reclosable fastener portion.

In a third use of the fastener assembly with a reclosable bag, a bag is formed from a barrier film material with the bag including front and rear walls, a bottom, top and sides with a line of weakness extending along the bag front wall between the sides. As part of the fastener assembly, the strip of barrier material is sealed to a flange of the first interlocking profile along a seal line extending between the line of weakness and the first interlocking profile. The strip of barrier material of the fastener assembly is joined by a barrier seal to the interior of the bag front wall and encompasses the bag front wall line of weakness and the barrier material line of weakness.

In a fourth use of the fastener assembly with a reclosable bag, a bag is formed from a barrier film material with the bag including front and rear walls, a bottom, top and sides with a line of weakness extending along the bag front wall between the sides. A barrier seal encompassing the bag wall line of weakness seals the strip of barrier material to an exterior surface of the front wall. A flange of the fastener assembly having the first interlocking profile is connected to an interior surface of the front wall on one side of the bag front wall line of weakness. The mating profile flange is joined to the interior of the front wall on an opposite side of the bag front wall line of weakness.

In a fifth use of the fastener assembly with a reclosable bag, a bag is formed from a barrier film material with the bag including front and rear walls, a bottom, top and sides with a line of weakness extending along the bag front wall between the sides. The strip of barrier material of the fastener assembly is connected to the first interlocking profile. A second profile having a flange is joined to an exterior of the front wall, with the second profile including an interlocking member mateable with the first interlocking profile. A barrier seal encompasses the mateable profiles and the front wall line of weakness, with the barrier seal joining the second profile flange to the front wall on one side of the mateable profiles and the strip of barrier material to the front wall on the opposite side of the mateable profiles. A peel seal joins the barrier strip to the second profile flange on a side of the mateable profiles opposite the line of weakness.

In a sixth use of the fastener assembly with a reclosable bag, a bag is formed from a barrier film material with the bag including front and rear walls, a bottom, top and sides with a line of weakness extending along the bag front wall between the sides. A strip of barrier material of the fastener assembly is connected to the first interlocking profile. A second profile having a flange is joined to an interior of the front wall, with the second profile including an interlocking member mateable with the first interlocking profile. A barrier seal encompasses the mateable profiles and the front wall line of weakness with the barrier seal joining the second profile flange to the front wall on one side of the mateable profiles and the strip of barrier material to the front wall on the opposite side of the mateable profiles. A peel seal joins the barrier strip to the second profile flange on the side of the mateable profiles with the line of weakness. In a seventh use of the fastener assembly with a reclosable bag, the fastener assembly includes the arrangement of the sixth use except that the barrier strip is extended. The extended barrier strip is sealed to the inside of the front on a face of the strip opposite to that of the first interlocking member.

DESCRIPTION OF THE DRAWINGS

Further objects and advantages of the invention will become apparent from the following description and claims and from the accompanying drawings, wherein:

DETAILED DESCRIPTION OF THE PREFERRED EMBODIMENT

Figure 1:
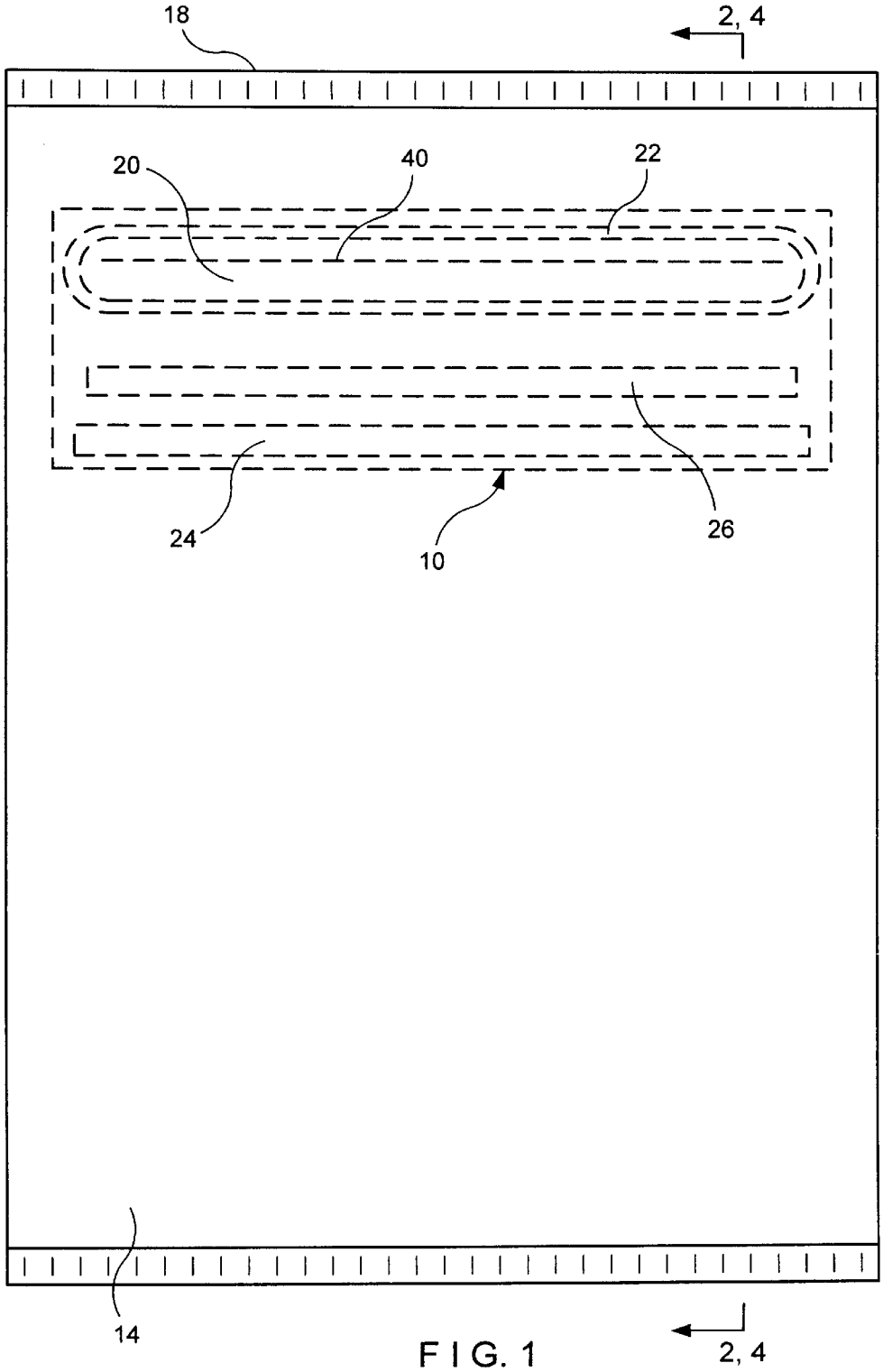
FIG. 1 is a front view of a fastener assembly with a barrier arrangement of a first and second use of the present invention depicting the fastener assembly attached to a reclosable bag.

Referring now to the drawings in detail wherein like numerals indicate like elements throughout the several views, a reclosable fastener assembly 10 in a first and second use of the present invention is shown in FIG. 1 as being attached to an associated bag 18. In the figure, the reclosable fastener assembly 10 including a barrier arrangement is attached to a front wall 14 of the reclosable plastic bag 18.

Figure 2:
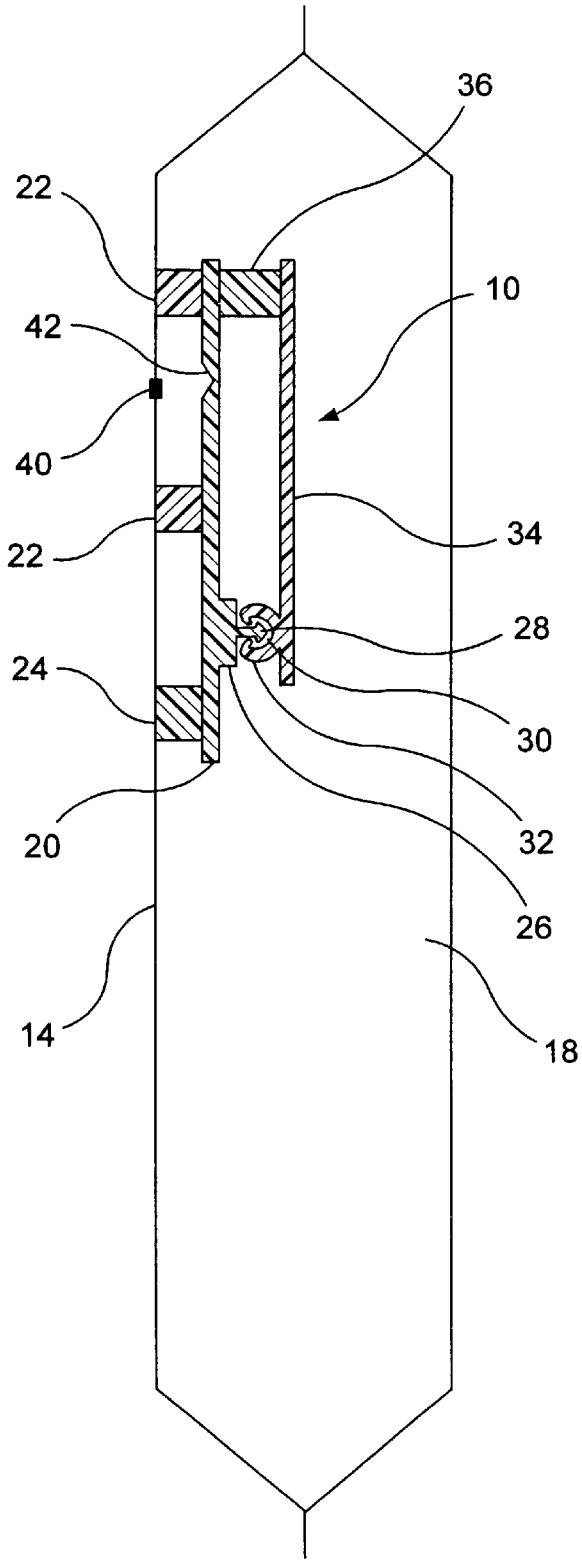
FIG. 2 is a cross-sectional view (exaggerated in a horizontal direction for purposes of illustration) of a fastener assembly of the first use of the present invention with the fastener assembly shown in a closed position and with the view taken from reference line 2—2 of FIG. 1.

As shown in FIG. 2, a barrier flange 20 is sealed by an oval barrier seal 22 to the inside of the front wall 14. The oval barrier seal 22, and the tacking seals described in the specification, may be accomplished by conventional heat-sealing or any other sealing process known to those skilled in the art. The distinction between the barrier and tack sealing being that the barrier seals preclude air or liquid from passing whereas the tacking seals do not necessarily do so. Also, even though an oval barrier seal is preferred, barrier seals of alternate shapes known to those skilled in the art may be used.

A lower section of the barrier flange 20 of the fastener assembly 10 is sealed to the front wall 14 at a tack seal 24. The tack seal 24 provides stability for the barrier strip when an interlocking profile 26 of the barrier flange 20 is accessed. The interlocking profile 26 of the figure is shaped to include a protuberance 28, which is interlockingly received in a groove 30 of an interlocking profile 32. However, other fasteners of interlocking profiles may be used by those skilled in the art. An interlocking profile 32 adapted to mate with interlocking profile 26 is integral to a mating profile flange 34. The mating profile flange 34 is sealed to the barrier flange 20 at a tack seal 36, with the tack seal providing an attachment area to the barrier flange 20 even when the interlocking profiles 26 and 32 are separated from one another.

To access the interlocking profiles 26 and 32 in order to open the reclosable bag 18, the front wall 14 is provided with a line of weakness 40. The line of weakness 40 may be a scoring, dimpling or perforation of the front wall 14 in a longitudinally extending direction between the sides of the reclosable bag 18 and within the oval barrier seal 22. The line of weakness 40 facilitates rupturing of the front wall 14 to provide an opening of the reclosable bag, which in turn allows access to the barrier flange 20. A single line of weakness 40 is shown and referenced in the following figures; however, a multi-line perforation may be substituted.

Figure 20:
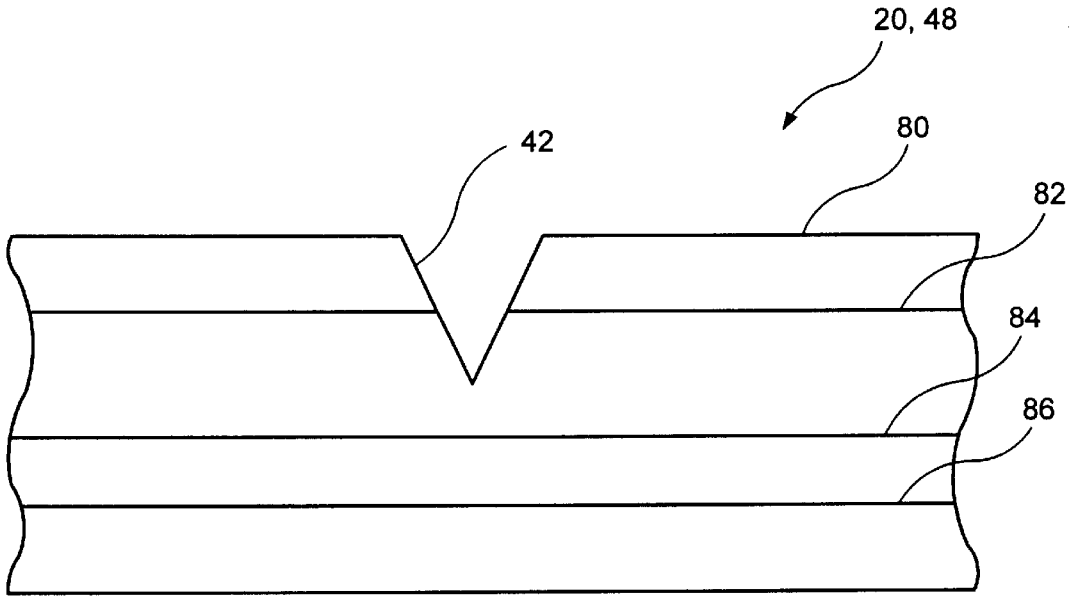
FIG. 20 is a detail view of the scored cut used on the barrier flanges and barrier tape in the uses of the present invention.

To access the interlocking profiles 26 and 32, the barrier flange 20 has a scored cut 42 which extends partially through the barrier strip between the sides of the reclosable bag 18 encompassed by the oval barrier seal 22. A single scored cut 42 is shown and referenced in the following figures; however, a multi-line scored cut may be substituted. The scored cut 42 allows the user to tear open the reclosable bag but is shallow enough so that the barrier attributes of the barrier flange 20 are maintained before the barrier flange is torn through. FIG. 20, which is later discussed, shows a detail of the score cut 42 and the affected layers of the barrier flange 20.

Figure 3:
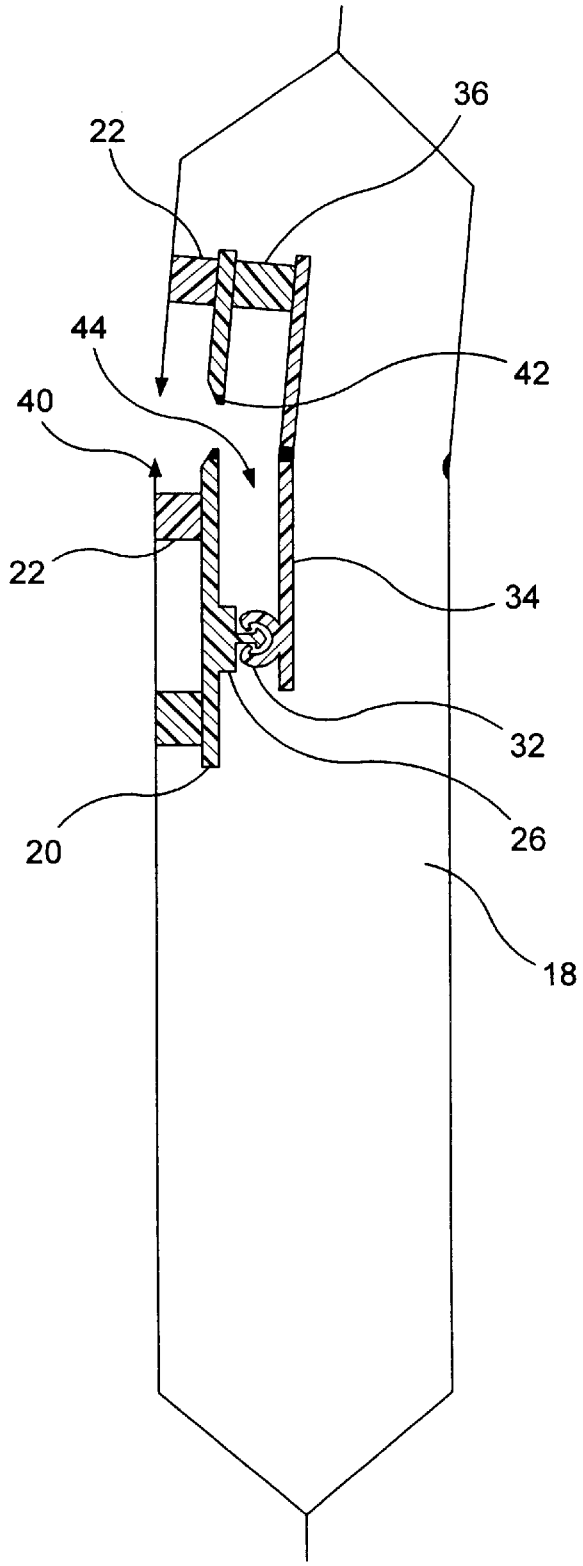
FIG. 3 is a cross-sectional view (exaggerated in a horizontal direction for purposes of illustration) of the fastener assembly of the first use of the present invention with the fastener assembly shown in an opened position.

As shown in FIG. 3, when the line of weakness 40 and the scored cut 42 are opened, access is provided to the interlocking profiles 26 and 32. The oval barrier seal 22 and the tack seal 36 secure the mating profile flange 34 to the front wall so that the sole pathway 44 to the bag interior is through the profiles when the line of weakness 40 and the scored cut 42 are opened. The pathway 44 allows the user to gain access to the interlocking profiles 26, 32 and to thereby gain access to the contents of the reclosable bag 18.

Figure 4:
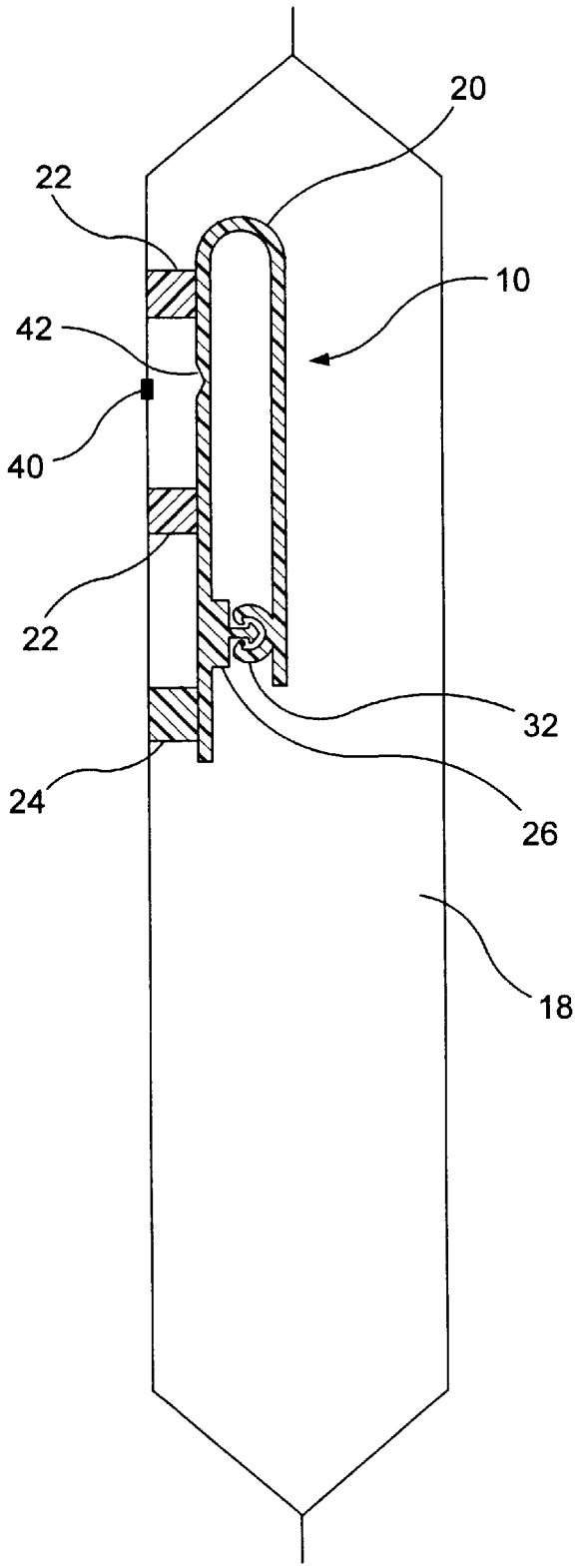
FIG. 4 is a cross-sectional view (exaggerated in a horizontal direction for purposes of illustration) of the fastener assembly of the second use of the present invention with the fastener assembly shown in a closed position and with the view taken from reference line 4—4 of FIG. 1.
Figure 5:
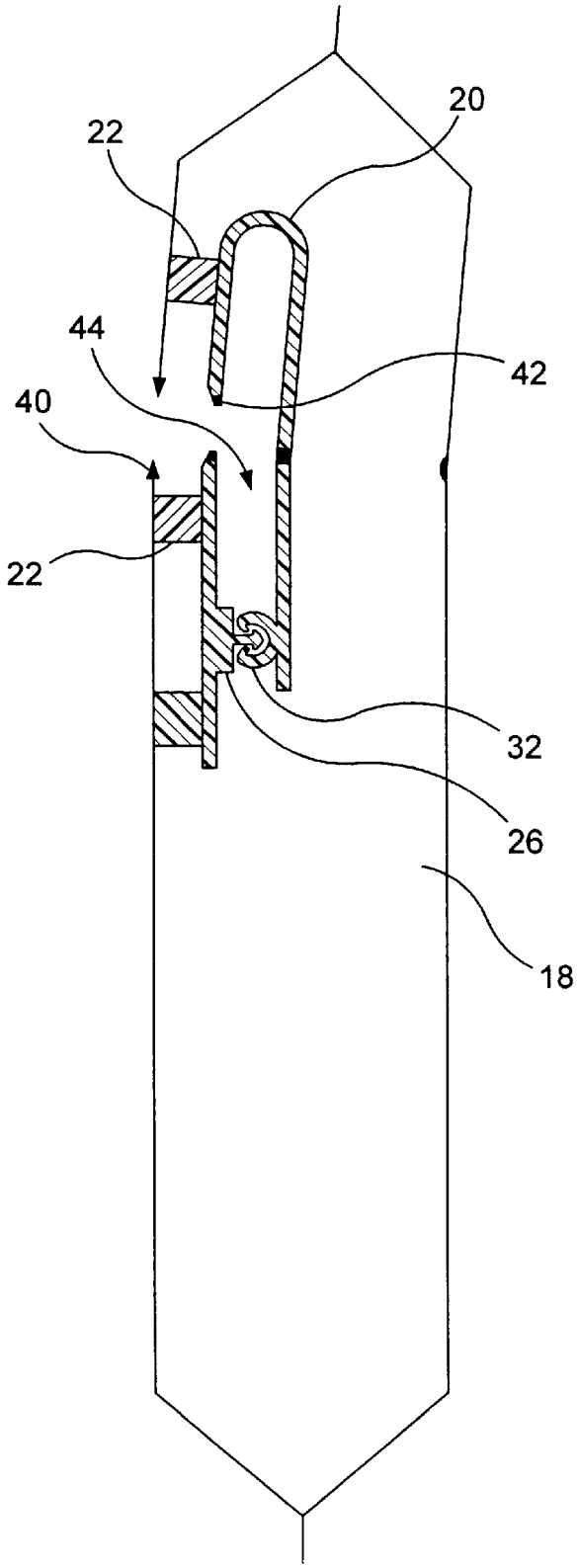
FIG. 5 is a cross-sectional view (exaggerated in a horizontal direction for purposes of illustration) of the fastener assembly of the second use of the present invention with the fastener assembly shown in an opened position.

A second use of the fastener assembly 10 is shown in FIG. 4. In the figure the barrier flange 20 is elongated and bent at an upper section and extended to include the interlocking profile 32, thereby allowing the interlocking profile 32 to be positioned opposite the interlocking profile 26. As shown in FIG. 5, when the line of weakness 40 and the scored cut 42 are opened, the oval barrier seal 22 secures the barrier flange 20 to the front wall so that the pathway 44 to the bag interior is through the interlocking profiles. That is, the pathway 44 allows the user to gain access to the interlocking profiles 26, 32 and to thereby gain access to the contents of the reclosable bag 18.

Figure 6:
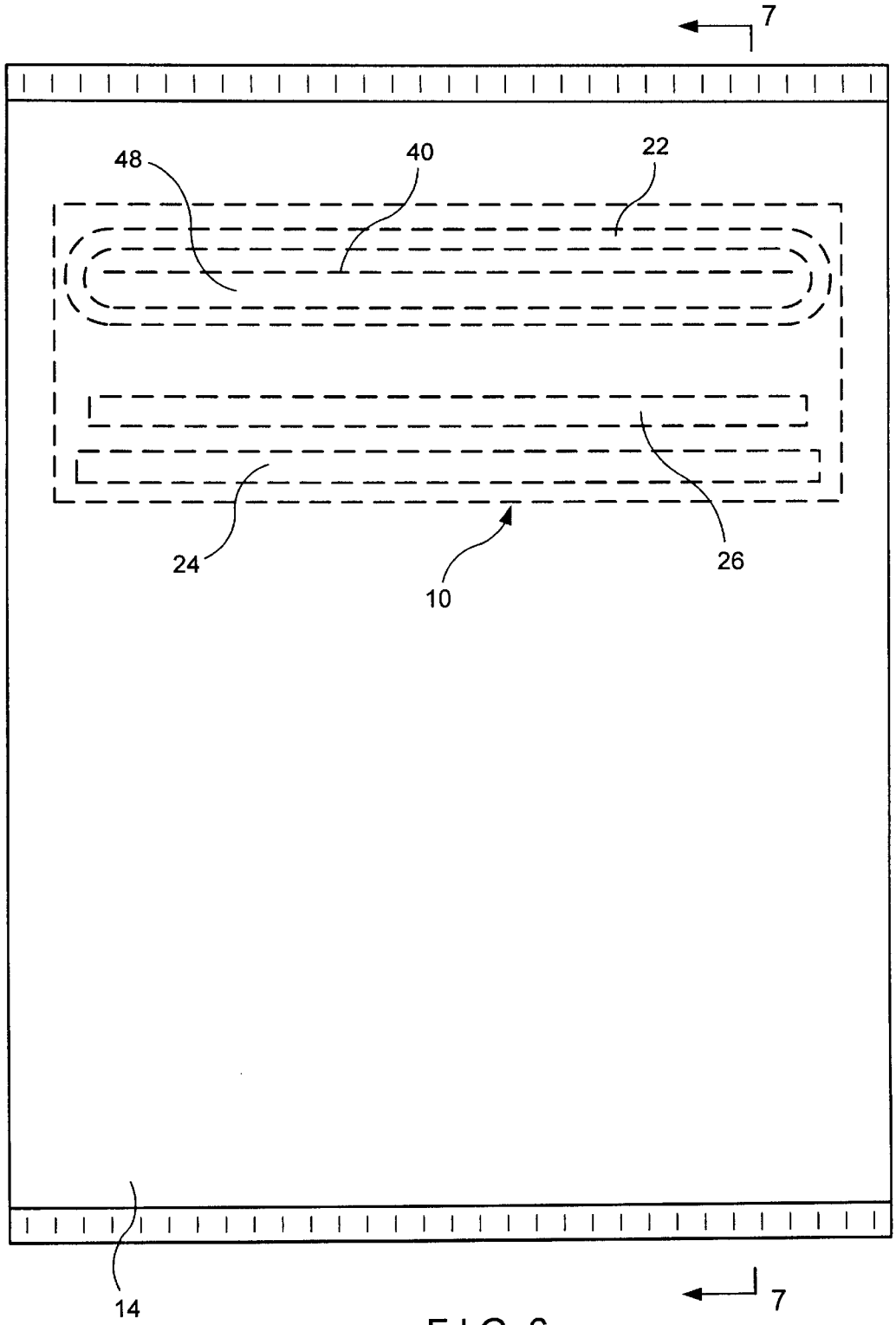
FIG. 6 is a front view of a fastener assembly with a barrier arrangement of a third use of the present invention depicting the fastener assembly attached to a reclosable bag.
Figure 7:
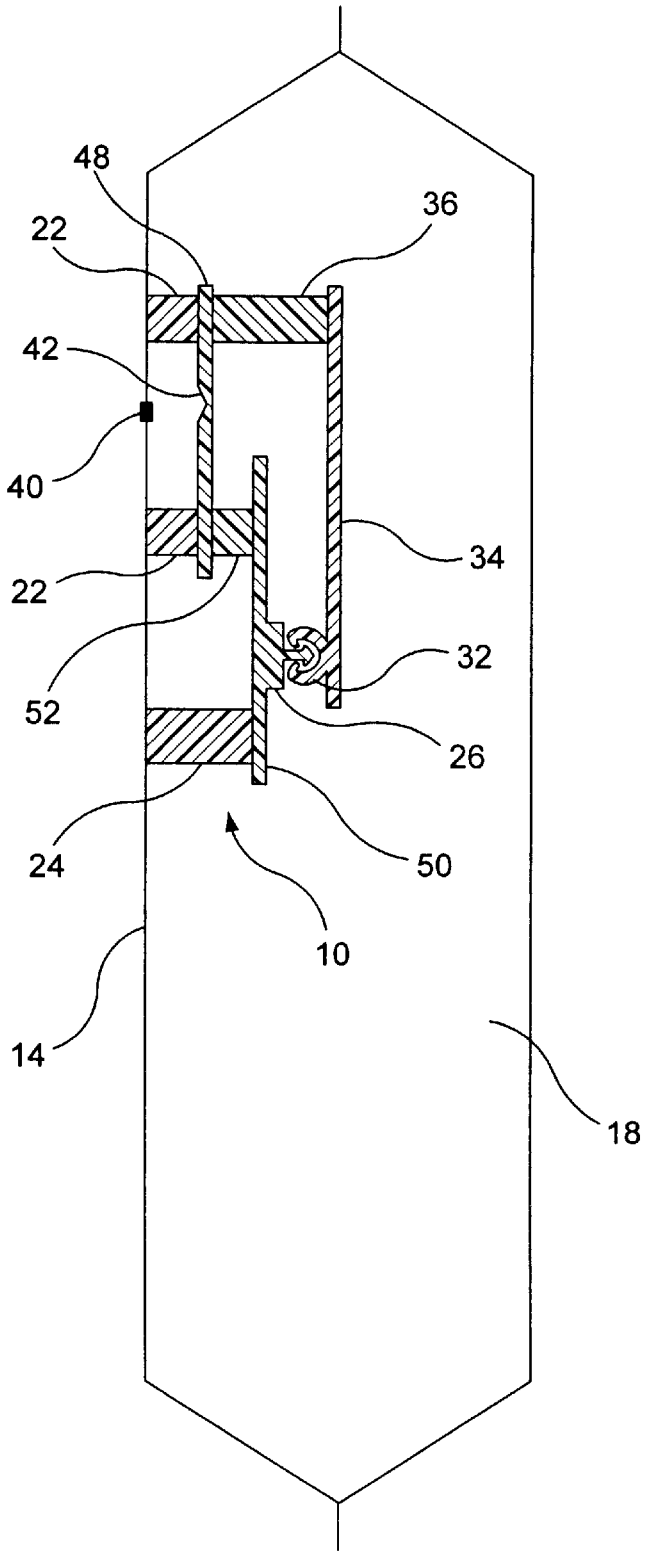
FIG. 7 is a cross-sectional view (exaggerated in a horizontal direction for purposes of illustration) of the fastener assembly of the third use of the present invention with the fastener assembly shown in a closed position and with the view taken from reference line 7—7 of FIG. 6.
Figure 8:
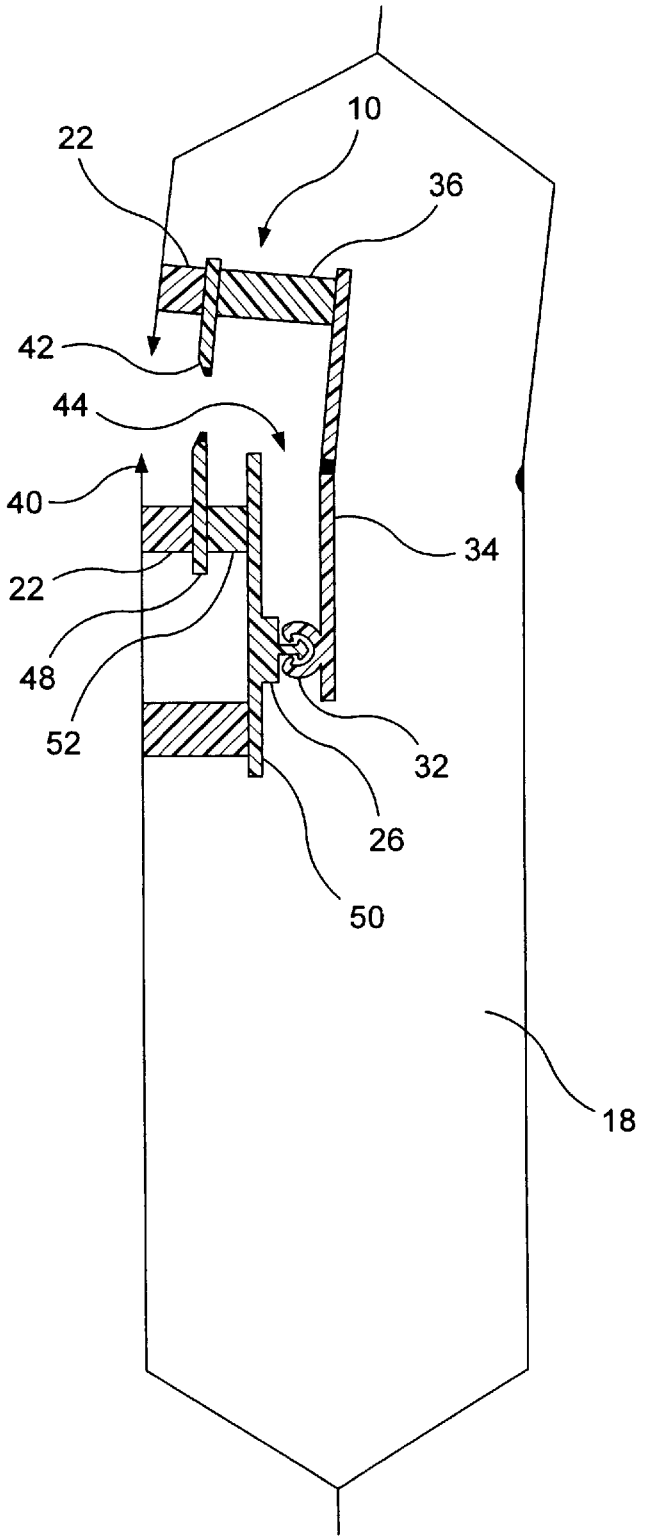
FIG. 8 is a cross-sectional view (exaggerated in a horizontal direction for purposes of illustration) of the fastener assembly of the third use of the present invention with the fastener assembly shown in an opened position.

A third use of the fastener assembly 10 of the present invention is shown in FIGS. 6, 7 and 8. In the front view of FIG. 6, a reclosable fastener assembly 10 including a barrier arrangement is attached by an oval barrier seal 22 to the front wall 14 of the reclosable plastic bag 18, with a line of weakness 40 within the oval barrier seal. In the cross-sectional view of FIG. 7, a strip of barrier tape 48 is sealed by the oval barrier seal 22 to the inside of the front wall 14. The oval barrier seal 22, along with the barrier tape 48, prevents air or liquids from entering or leaving the reclosable bag 18 even if the front wall 14 in the area encompassed by the oval barrier seal 22 is ruptured. A closure flange 50 is sealed to the barrier tape 48 at a tack seal 52 and to the front wall at a seal 24 below the lower edge of the strip of barrier tape 48. The tack seals 24 and 52 provide stability for the closure flange when an interlocking profile 26 of the closure flange 50 is accessed. The interlocking profile 26 is interlockable with an interlocking profile 32 of a mating profile flange 34. The mating profile flange 34 is sealed to the strip of barrier tape 48 at a tack seal 36, with the tack seal 36 providing an attachment area to the strip of barrier tape 48 even when the interlocking profiles 26 and 32 are separated from one another.

To access the strip of barrier tape 48, the front wall 14 of the reclosable bag 18 is provided with a line of weakness 40. To access the interlocking profiles 26 and 32 in order to open the bag, the strip of barrier tape 48 includes a scored cut 42. The scored cut 42 of the strip of barrier tape 48 allows the user to tear through the barrier tape, but is shallow enough so that the barrier attributes of the barrier tape are maintained before it is torn through. FIG. 20, which is later discussed, shows a detail of the scored cut 42 and the affected layers of the barrier tape 48.

As shown in FIG. 8, when the line of weakness 40 and the scored cut 42 are opened, access is provided to the interlocking profiles 26 and 32. The oval barrier seal 22 and the tack seal 36 secure the mating profile flange 34 and the closure flange 50 to the front wall so that the sole pathway 44 to the bag interior is through the profiles when the line of weakness 40 and the scored cut 42 are opened. The pathway 44 allows the user to gain access to interlocking profiles 26, 32 and to thereby gain access to the contents of the reclosable bag 18.

Figure 9:
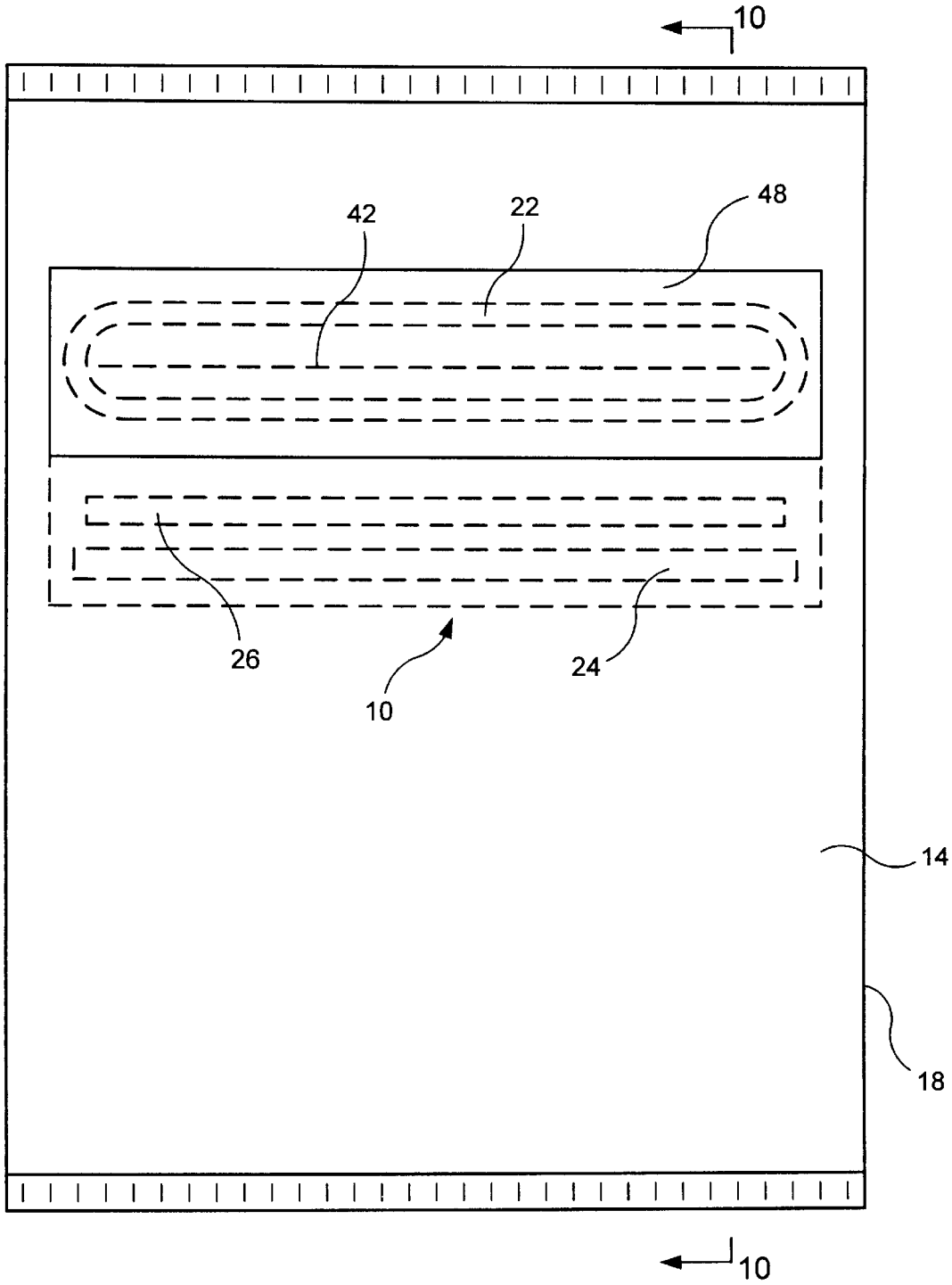
FIG. 9 is a front view of a fastener assembly with a barrier arrangement of a fourth use of the present invention depicting the fastener assembly attached to a reclosable bag.
Figure 10:
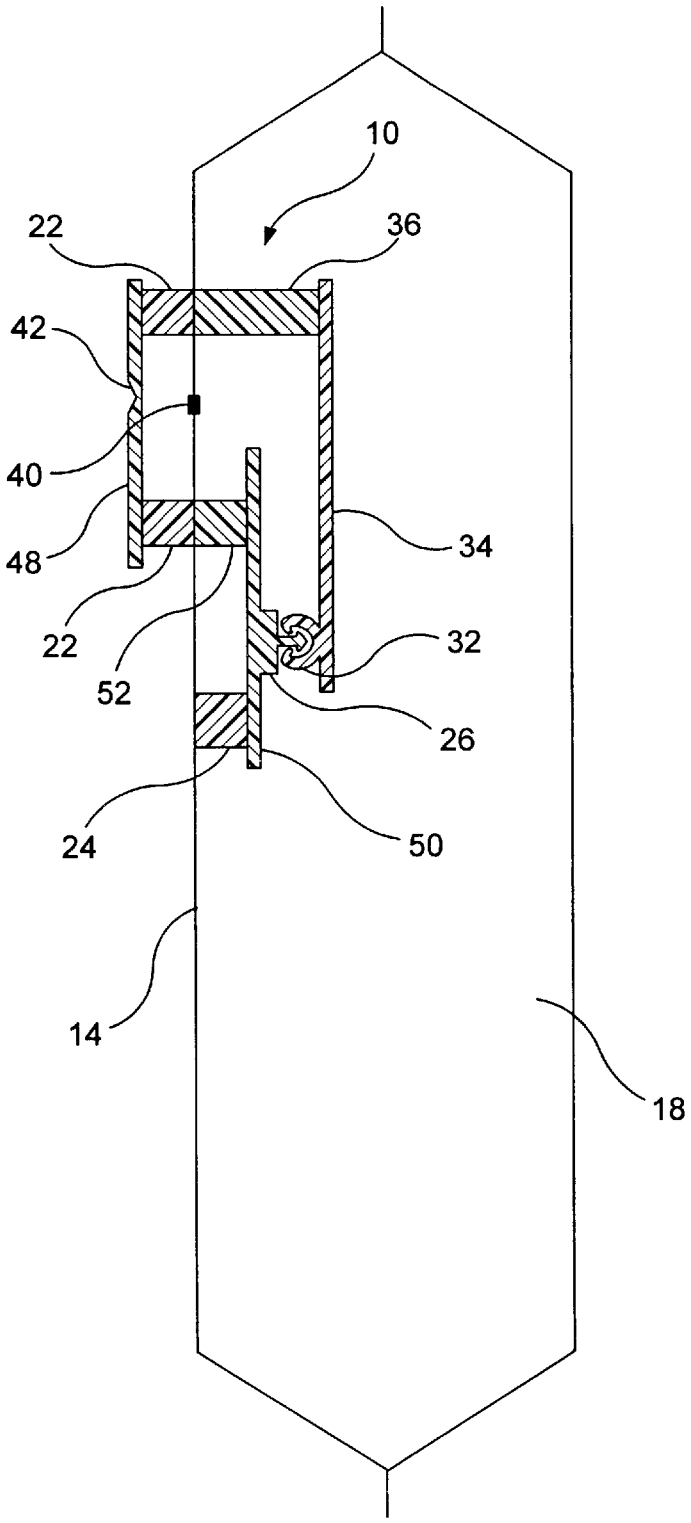
FIG. 10 is a cross-sectional view (exaggerated in a horizontal direction for purposes of illustration) of the fastener assembly of the fourth use of the present invention with the fastener assembly shown in a closed position and with the view taken from reference line 10—10 of FIG. 9.
Figure 11:
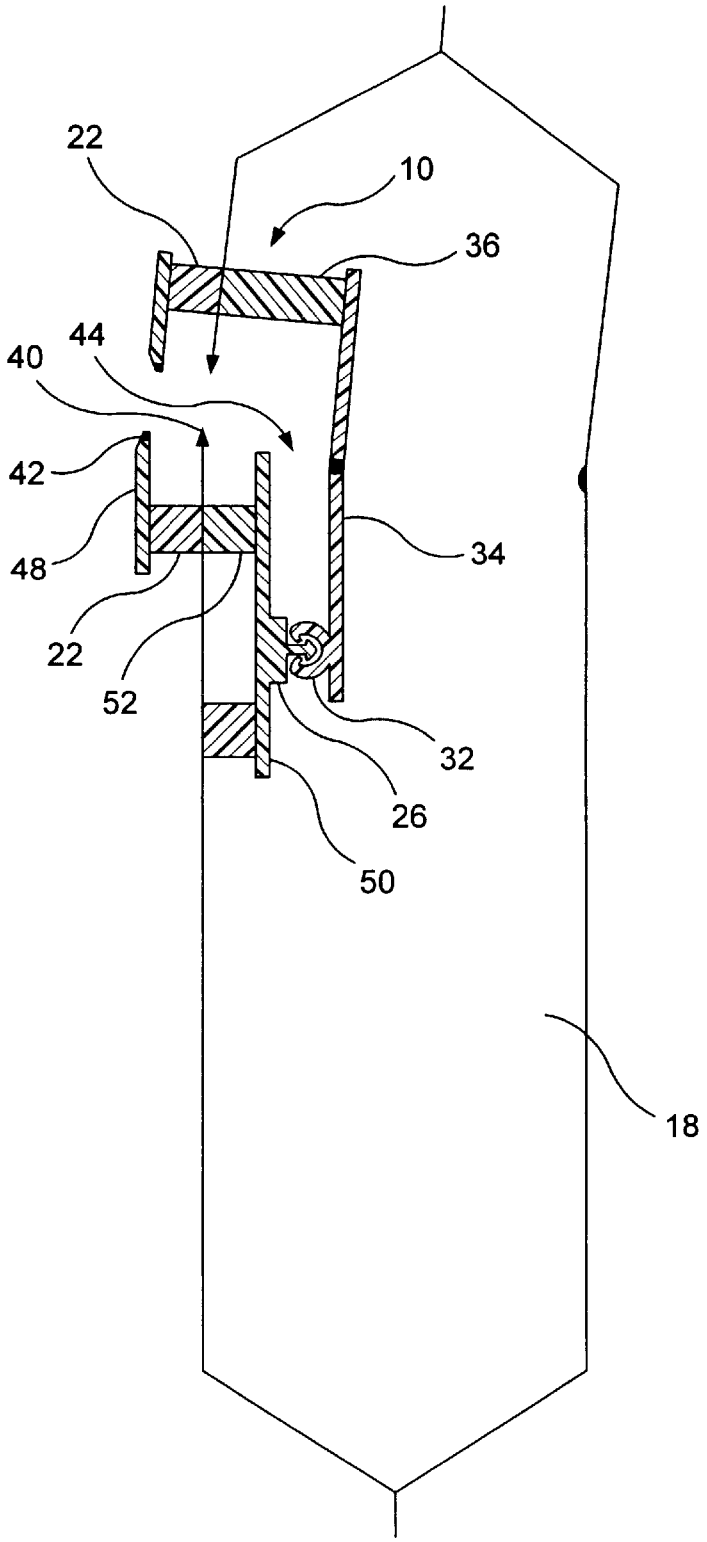
FIG. 11 is a cross-sectional view (exaggerated in a horizontal direction for purposes of illustration) of the fastener assembly of the fourth use of the present invention with the fastener assembly shown in an opened position.

A fourth use of the fastener assembly 10 of the present invention is shown in FIGS. 9, 10 and 11. In the front view of FIG. 9, a reclosable fastener assembly 10, including a barrier arrangement, is attached by an oval barrier seal 22 to the front wall 14 of the reclosable bag. In this use, a strip of barrier tape 48 with a scored cut 42 is attached to the exterior wall 14 encompassed by the oval barrier seal.

On the inside of the front wall 14, a closure flange 50 is sealed to the wall of the reclosable bag at tack seals 24 and 52, with the tack seals 24 and 52 providing stability for the closure flange when an interlocking profile 26 is accessed. The interlocking profile 26 is interlockable with an interlocking profile 32 of a mating profile flange 34. The mating profile flange 34 is sealed to the inside of the front wall 14 with the tack seal 36, thereby providing an attachment area for the mating profile flange 34 when the interlocking profiles 26 and 32 are separated from one another.

To access the interlocking profiles 26 and 32, the front wall 14 is provided with a line of weakness 40. To access the line of weakness 40, the strip of barrier tape 48 has a scored cut 42. As shown in FIG. 11, when the line of weakness 40 and the scored cut 42 are opened, access is provided to the interlocking profiles 26 and 32. The tack seals 36 and 52 secure the mating profile flange 34 and the closure flange 50 to the front wall so that the sole pathway 44 to the bag interior is through the profiles when the line of weakness 40 and the scored cut 42 are opened. The pathway 44 allows the user to gain access to interlocking profiles 26, 32 and to thereby gain access to the contents of the reclosable bag 18.

Figure 12:
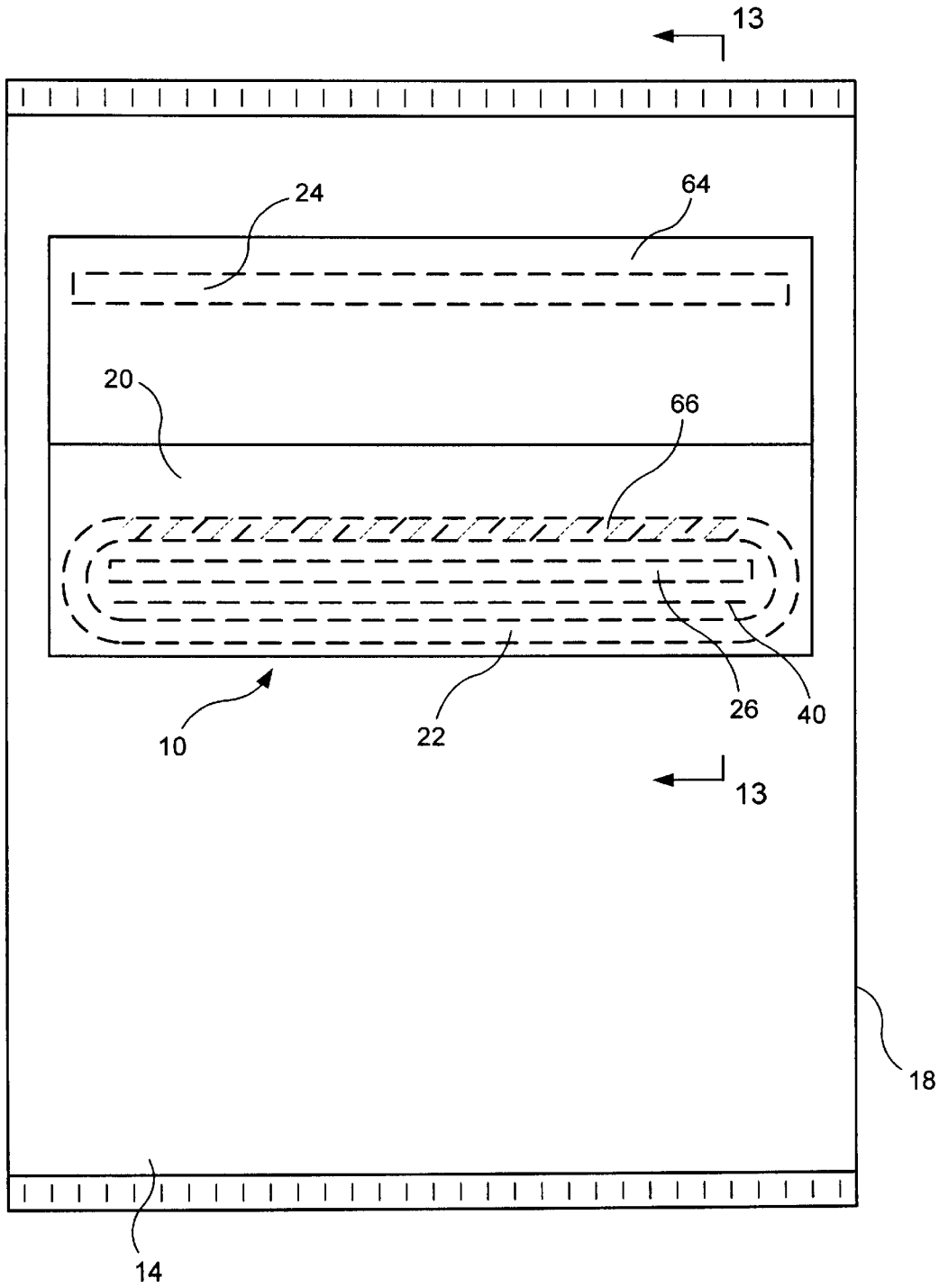
FIG. 12 is a front view of a fastener assembly with a barrier arrangement of a fifth use of the present invention depicting the fastener assembly attached to a reclosable bag.
Figure 13:
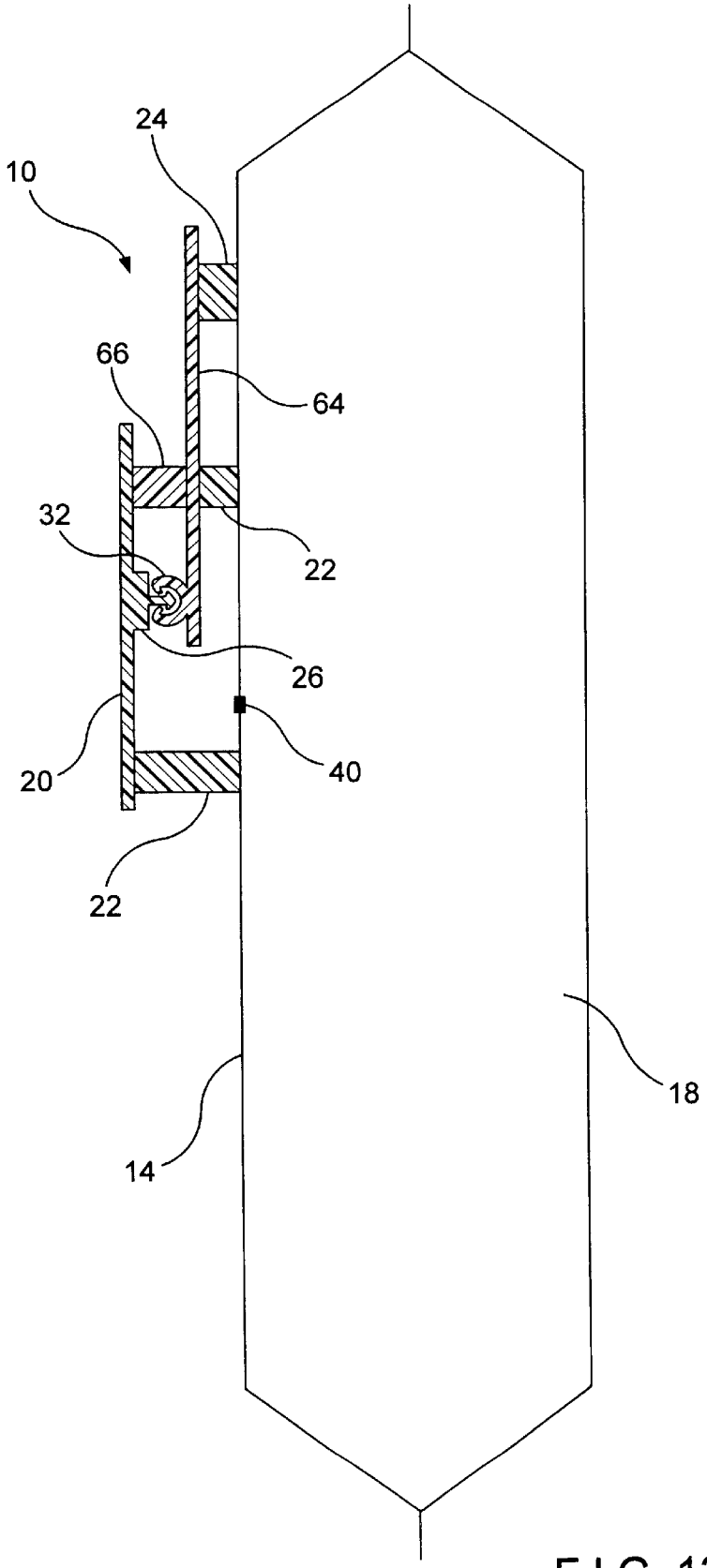
FIG. 13 is a cross-sectional view (exaggerated in a horizontal direction for purposes of illustration) of the fastener assembly of the fifth use of the present invention with a peelable seal shown in a closed position and with the view taken from reference line 13—13 of FIG. 12.
Figure 14:
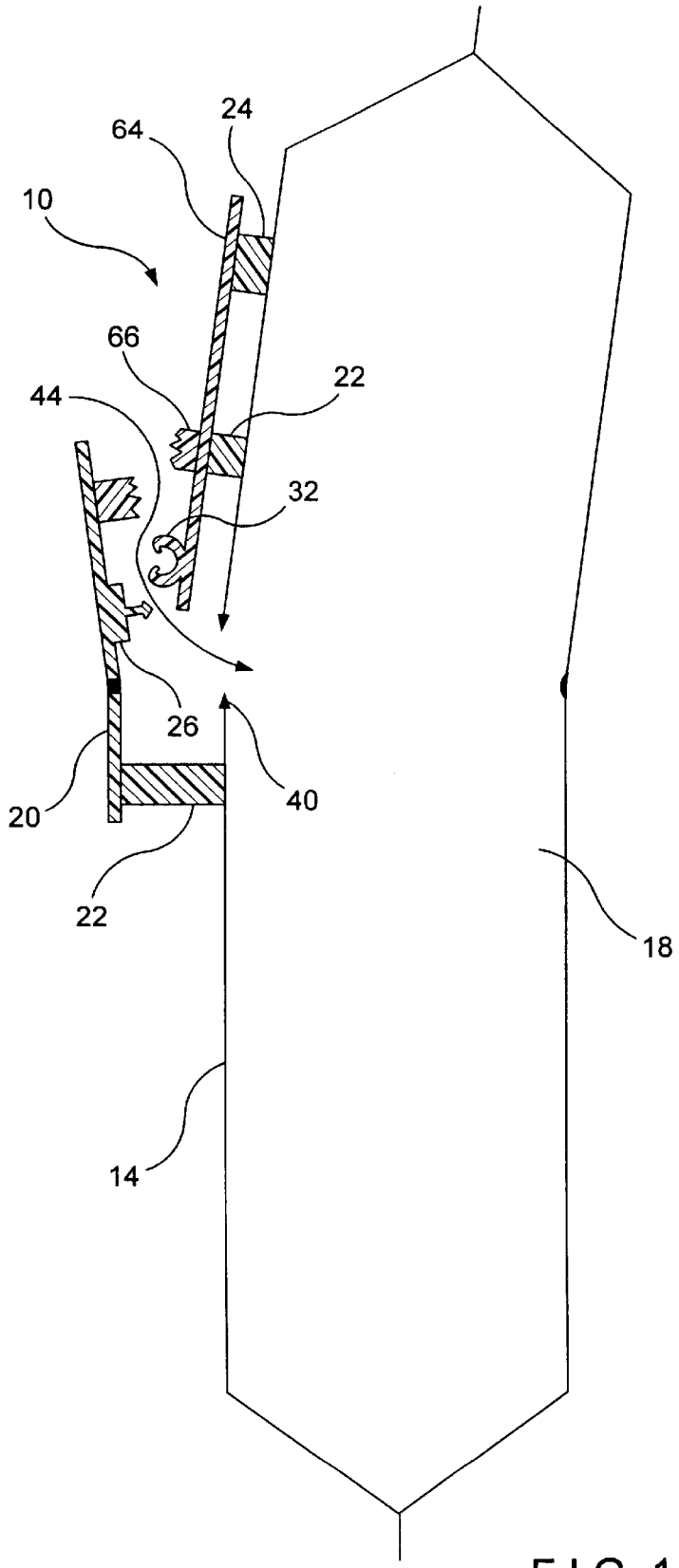
FIG. 14 is a cross-sectional view (exaggerated in a horizontal direction for purposes of illustration) of the fastener assembly of the fifth use of the present invention with a peelable seal shown in an opened position.

A fifth use of the fastener assembly 10 of the present invention is shown in FIGS. 12, 13 and 14. In the front view of FIG. 12, a barrier flange 20 is sealed by an oval barrier seal 22 to the outside of the front wall 14 with the barrier strip sealed to a flange 64 by a peelable seal 66. The flange 64 is sealed to the outside of the front wall 14 by a section of the oval barrier seal 22 in alignment with the peelable seal 66. The flange 64 is also sealed to the outside of the front wall 14 by a tack seal 24. In the cross-sectional view of FIG. 13, the peelable seal 66 provides an opening section of the oval barrier seal 22, allowing access to the interlocking profiles 26 and 32. However, if the peelable seal 66 is torn open, the barrier flange 20 and the flange 64 protect the line of weakness 40 from also being torn open inadvertently.

As shown in FIG. 14, when the line of weakness 40, the interlocking profiles 26 and 32 and the line of weakness 40 are opened, access is provided to the contents of the reclosable bag 18. The oval barrier seal 22 secures the flanges 20 and 64 to the front wall so that the sole pathway 44 to the bag interior is through the profiles. The pathway 44 allows the user to gain access to the interlocking profiles 26, 32 and to thereby gain access to the contents of the reclosable bag 18.

Figure 15:
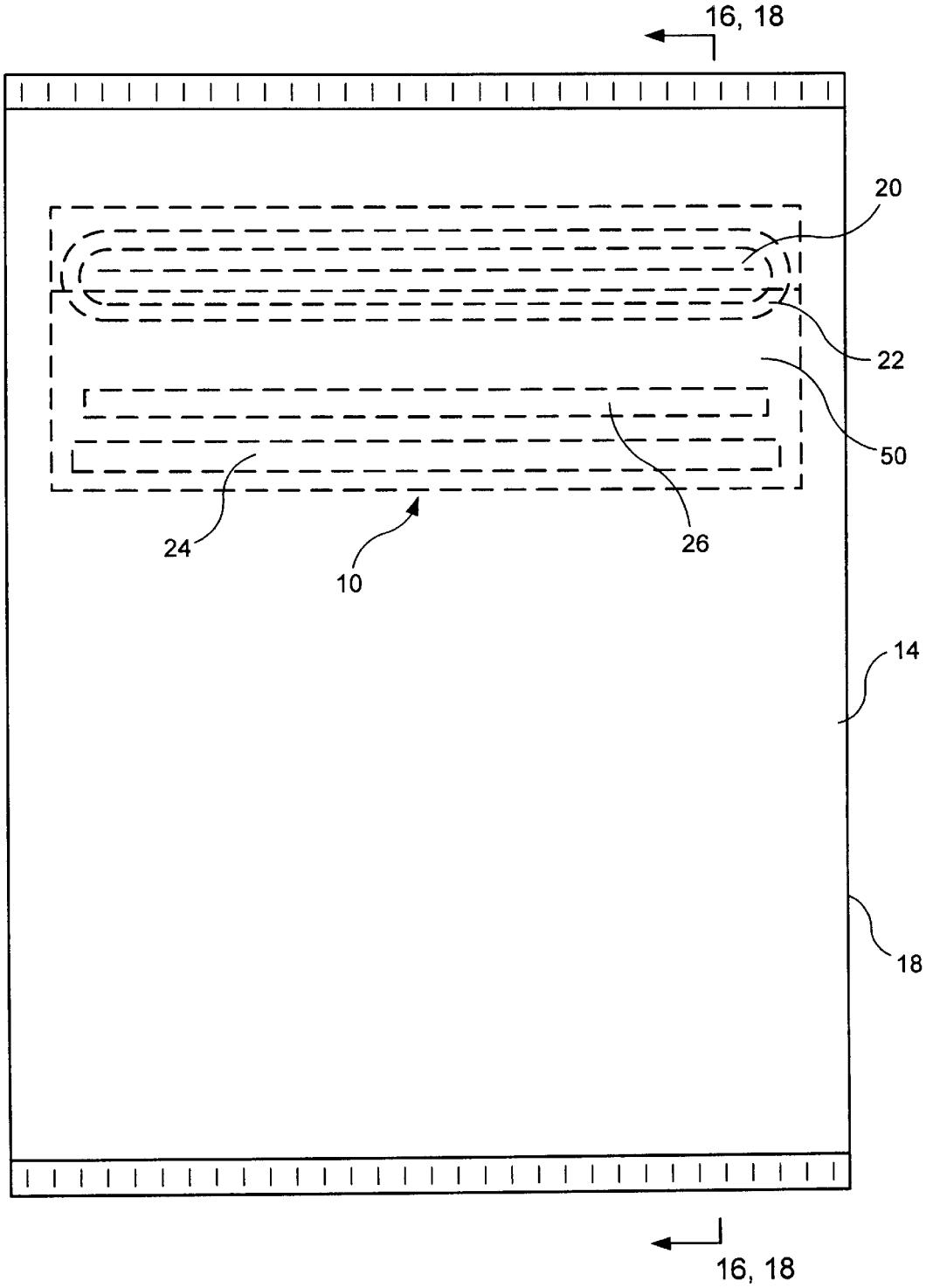
FIG. 15 is a front view of a fastener assembly with a barrier arrangement of a sixth and a seventh use of the present invention depicting the fastener assembly attached to a reclosable bag.
Figure 16:
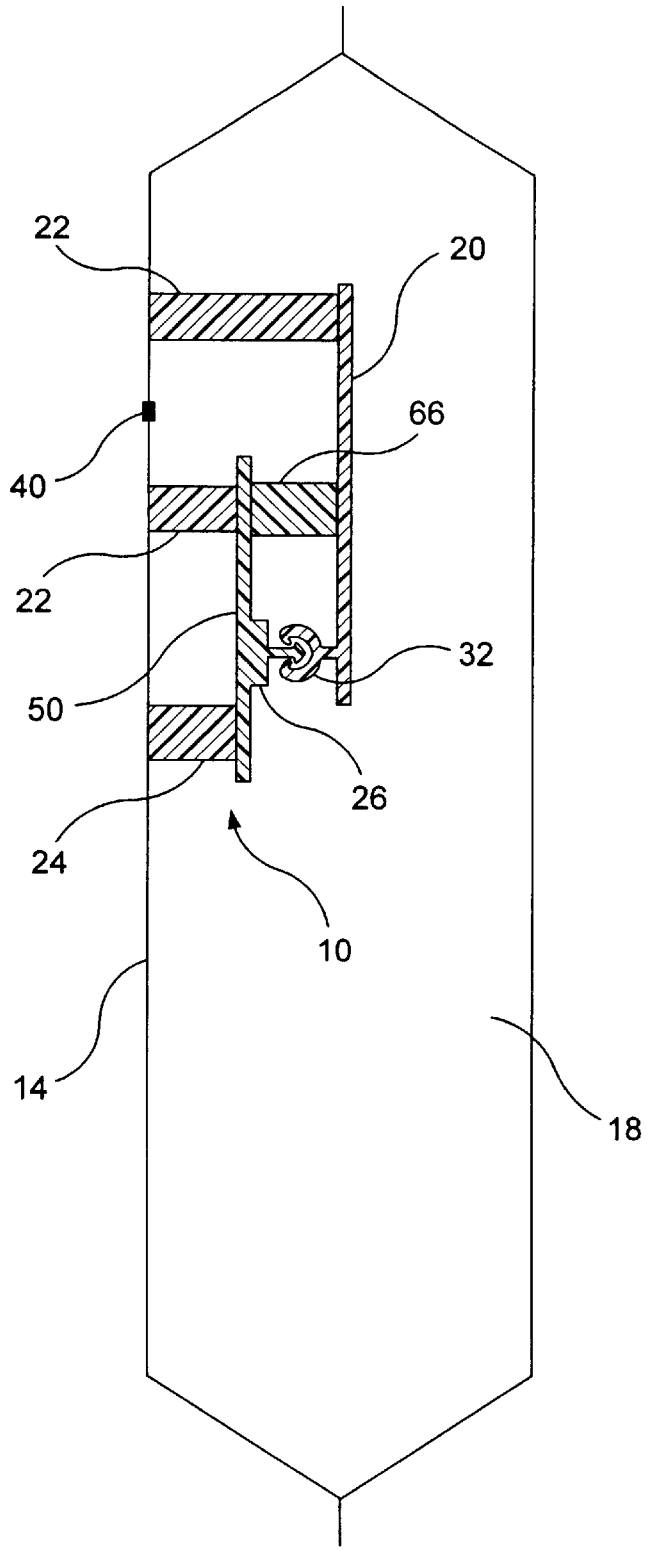
FIG. 16 is a cross-sectional view (exaggerated in a horizontal direction for purposes of illustration) of the fastener assembly of the sixth use of the present invention with a peelable seal shown in a closed position and with the view taken from reference line 16—16 of FIG. 15.
Figure 17:
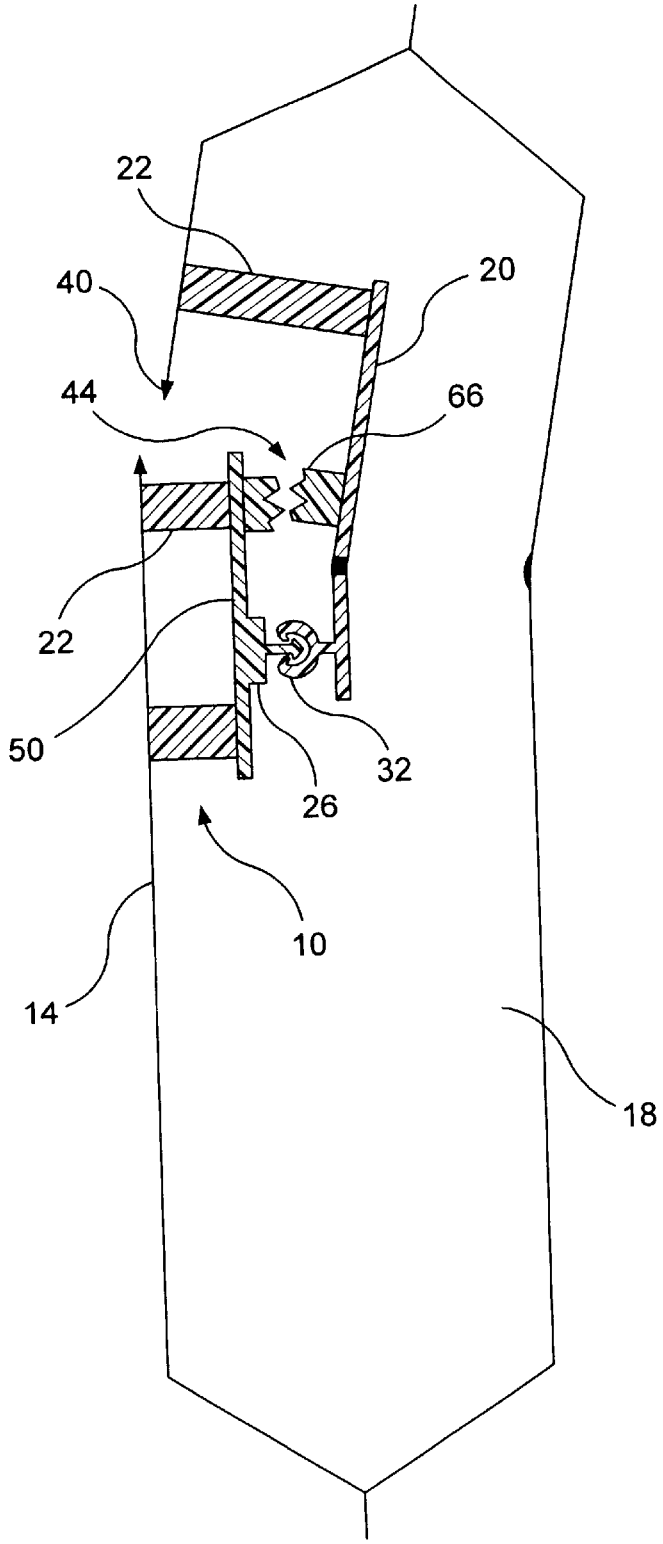
FIG. 17 is a cross-sectional view (exaggerated in a horizontal direction for purposes of illustration) of the fastener assembly of the sixth use of the present invention with a peelable seal shown in an opened position.

A sixth use of the fastener assembly 10 of the present invention is shown in FIGS. 15, 16, and 17. In the front view of FIG. 15, a reclosable fastener assembly 10, including a barrier flange 20, is attached to the front wall 14 by an oval barrier seal 22 of the reclosable bag 18 with a line of weakness 40 encompassed by the oval barrier seal. In the cross-sectional view of FIG. 16, the barrier flange 20 and a closure flange 50 are sealed by an oval barrier seal 22 to the front wall 14 of the reclosable bag 18. The barrier flange 20 also seals to the closure flange 50 at a peelable seal 66. The peelable seal 66 provides an opening section of the barrier arrangement, allowing access to interlocking profiles 26 and 32. Even if the line of weakness 40 is torn open, the oval barrier seal 22 and the peelable seal 66 will still prevent air or liquid from entering or leaving the reclosable bag.

The interlocking profile 32 is integral to the barrier flange 20 and is interlockable with the interlocking profile 26 of the closure flange 50. A tack seal 24 seals a lower end of the closure flange 50 to the front wall 14 of the reclosable bag. The tack seal 24 provides stability to the closure flange 50 when the interlocking profiles 26 and 32 are opened; however, a larger barrier seal 22 may be used in place of the tack seal 24. As shown in FIG. 17, when the line of weakness 40 and the peelable seal 66 are opened, access is provided to the interlocking profiles 26 and 32. The oval barrier seal 22 secures the barrier flange 20 and the closure flange 50 to the front wall so that the sole pathway 44 to the bag interior is through the profiles. The pathway 44 allows the user to gain access to interlocking profiles 26, 32 and to thereby gain access to the contents of the reclosable bag 18.

Figure 18:
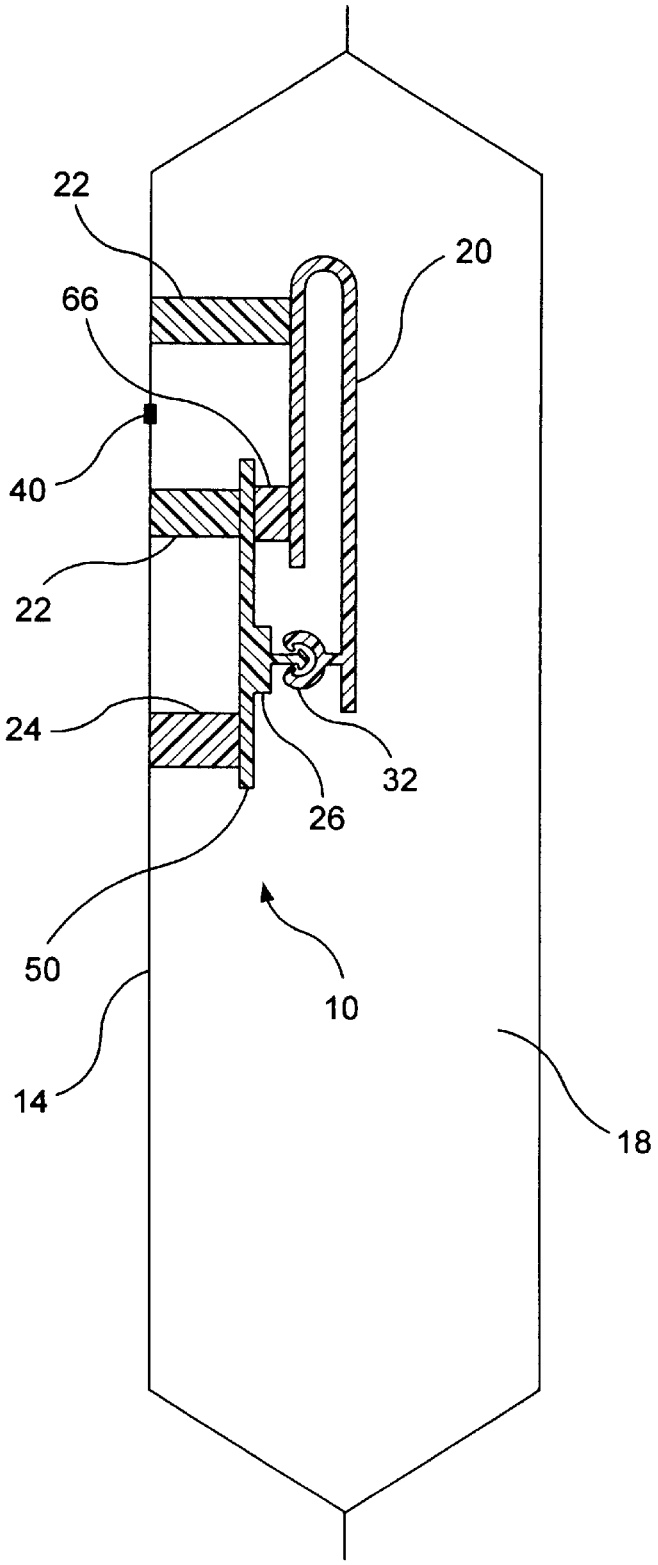
FIG. 18 is a cross-sectional view (exaggerated in a horizontal direction for purposes of illustration) of the fastener assembly of the seventh use of the present invention with a peelable seal shown in a closed position and with the view taken from reference line 18—18 of FIG. 16.
Figure 19:
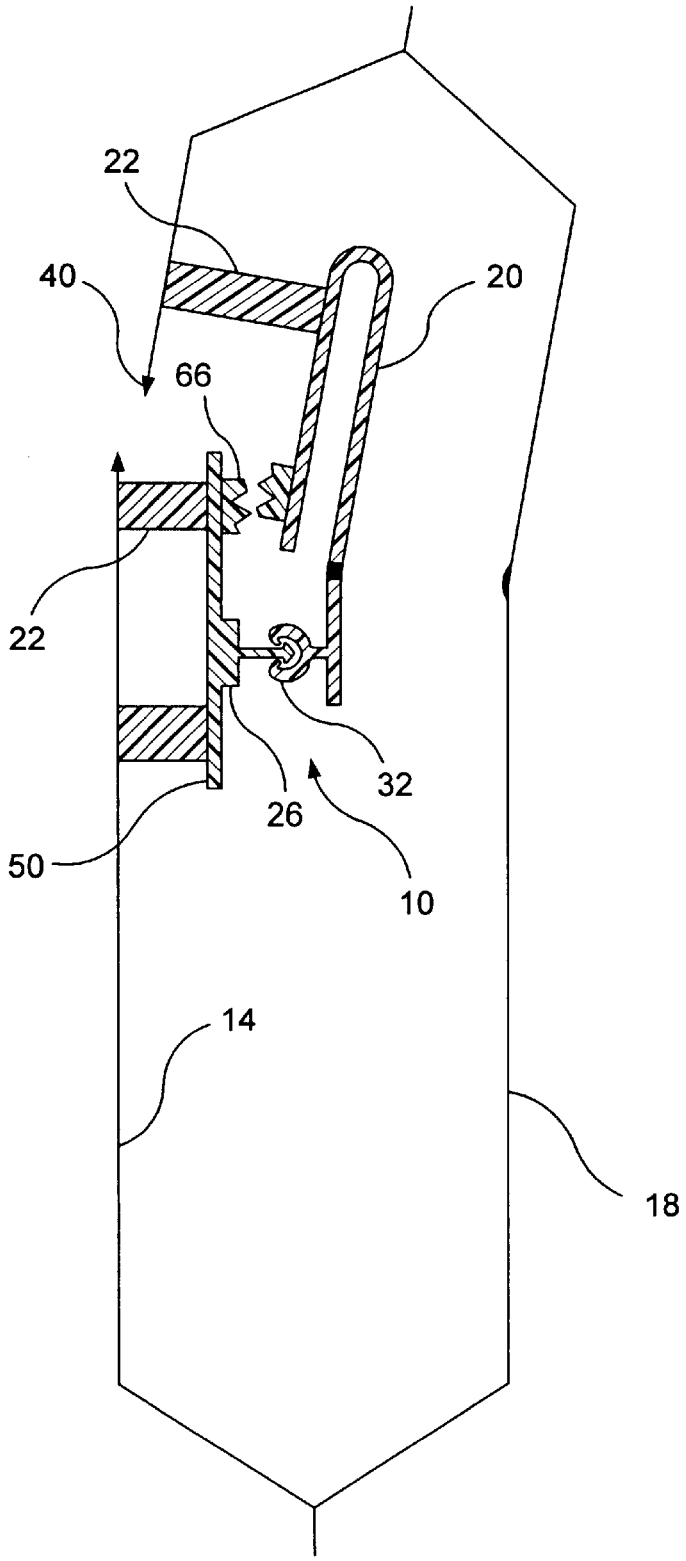
FIG. 19 is a cross-sectional view (exaggerated in a horizontal direction for purposes of illustration) of the barrier arrangement of the seventh use of the present invention with a peelable seal shown in an opened position.

A seventh use of the fastener assembly 10 is shown in FIGS. 15, 18, and 19. In the front view of FIG. 15, a reclosable fastener assembly 10 including a barrier flange 20 is attached to the front wall 14 by an oval barrier seal 22, with a line of weakness 40 encompassed by the oval barrier seal. In the cross-sectional view of FIG. 18, a closure flange 50 is also sealed by an oval barrier seal 22 to the front wall 14 of the reclosable bag 18. The barrier flange 20 also seals to the closure flange 50 at a peelable seal 66. Even if the line of weakness 40 is torn open, the oval barrier seal 22 and the peelable seal 66 will still prevent air or liquid from entering or leaving the reclosable bag.

The peelable seal 66 provides an opening section of the barrier arrangement, allowing access to interlocking profiles 26 and 32. The interlocking profile 26 of the closure flange 50 is interlockable with the interlocking profile 32 of the barrier flange 20. In this use, the interlocking profile 32 is on a face of the extended barrier flange 20 opposite the face of the barrier flange that includes the peelable seal 66. A tack 24 seals a lower end of the closure flange 50 to the front wall 14, thereby providing stability to the closure flange 50 when the interlocking profiles 26 and 32 are opened; however, a larger barrier seal 22 may be used in place of the tack seal 24.

As shown in FIG. 19, when the line of weakness 40 and the peelable seal 66 are opened, access is provided to the interlocking profiles 26 and 32. The oval barrier seal 22 secures the barrier flange 20 and the closure flange 50 to the front wall so that the sole pathway 44 to the bag interior is through the profiles. The pathway 44 allows the user to gain access to interlocking profiles 26, 32 and to thereby gain access to the contents of the reclosable bag 18.

A detail of the barrier flange 20 and the strip barrier tape 48 is shown in FIG. 20. In the figure, the scored cut 42 is sliced through a sealant layer 80 and a strength layer 82. The sealant layer is typically a linear low-density polyethylene material or similar materials known to those skilled in the art. The strength layer 82 is typically polyethylene terephthalate. By not fully slicing through the strength layer 82, the integrity of the barrier flange 20 or the strip of barrier tape is maintained. A barrier layer 84 prevents moisture and oxygen from entering the reclosable bag. Another sealant layer 86 is provided to protect the layer of the barrier material and to provide a sealing surface.

Thus the several aforementioned objects and advantages are most effectively attained. Although preferred uses of the invention have been disclosed and described in detail herein, it should be understood that this invention is in no sense limited thereby and its scope is to be determined by that of the appended claims.

What is claimed is:

1. A reclosable bag formed from barrier film material, said reclosable bag including:

front and rear walls, a bottom, a top and sides, with a line of weakness extending along said bag front wall between said sides;

a fastener assembly including a strip formed of barrier material having a line of weakness extending along a length of said strip of barrier material and a first interlocking profile connected to said strip of barrier material and extending parallel to said line of weakness, said line of weakness not interfering with the barrier properties of said strip of barrier material and a mating profile flange joined to said strip of barrier material on a side of said line of weakness opposite to said first interlocking profile, said mating profile flange including a second interlocking profile mateable with said first interlocking profile; and a barrier seal joining said strip of barrier material to said bag front wall and encompassing said bag front wall line of weakness and said barrier material line of weakness.

2. The reclosable bag in accordance with claim 1 wherein said strip of barrier material is joined to an interior surface of said bag front wall.

3. The reclosable bag in accordance with claim 1 wherein said barrier material line of weakness comprises a score line extending partially through said strip of barrier material.

4. The reclosable bag in accordance with claim 1 wherein said strip of barrier material comprises a flange of said first interlocking profile.

5. The reclosable bag in accordance with claim 4 wherein said strip of barrier material further comprises the mating profile flange.

6. The reclosable bag in accordance with claim 1 further comprising a seal line joining said first interlocking profile to said bag front wall along a line not encompassed by said barrier seal.

7. The reclosable bag in accordance with claim 1 wherein said strip of barrier material is outward from an exterior surface of said bag front wall.

8. A reclosable bag formed from barrier film material, said reclosable bag including:

front and rear walls, a bottom, a top and sides, with a line of weakness extending along said bag front wall between said sides;

a strip formed of barrier material sealed to an exterior surface of said front wall by a barrier seal encompassing said line of weakness;

a first interlocking profile having a flange connected to said bag front wall on one side of said line of weakness;

and a second interlocking profile mateable with said first interlocking profile with a flange of said second profile joined to said bag front wall on an opposite side of said bag front wall line of weakness.

9. The reclosable bag in accordance with claim 8 wherein said barrier material line of weakness comprises a score line extending partially through said strip of barrier material.

10. The reclosable bag in accordance with claim 9 wherein said first interlocking profile and said second interlocking profile are positioned inwardly of interior surfaces of said bag front wall.

11. A reclosable bag formed from barrier film material, said reclosable bag including:

front and rear walls, a bottom, a top and sides, with a line of weakness extending along said bag front wall between said sides;

a strip of barrier material;

a first interlocking profile connected to said strip of barrier material a second interlocking profile mateable with said first interlocking profile;

a barrier seal encompassing said mateable profiles and said bag front wall line of weakness, said barrier seal joining a flange of said second profile to said bag front wall on one side of said mateable profiles and joining said strip of barrier material to said bag front wall on an opposite side of said mateable profiles; and a peel seal joining said strip of barrier material to said flange on a side of said mateable profiles opposite said line of weakness.

12. The reclosable bag of claim 11 wherein said strip of barrier material and said second profile are connected to an exterior surface of said bag front wall.

13. The reclosable bag of claim 11 wherein said strip of barrier material and said second profile are connected to an interior surface of said bag front wall with said peel seal joining said strip to said second profile flange.

* * * * *